United States Patent [19]

Tucker, Jr.

[11] 3,997,082

[45] Dec. 14, 1976

[54] LIQUID CONTAINER WITH IMPROVED POURING UNIT

[76] Inventor: Ronald F. Tucker, Jr., 156 S. Ashland Ave., Palatine, Ill. 60067

[22] Filed: Sept. 8, 1975

[21] Appl. No.: 610,958

Related U.S. Application Data

[63] Continuation of Ser. No. 399,677, Sept. 21, 1973, abandoned, which is a continuation of Ser. No. 207,390, Dec. 13, 1971, abandoned.

[52] U.S. Cl. ..... 222/108; 222/472

[51] Int. Cl.[2] ..... B67D 3/00

[58] Field of Search ..... 222/465, 472, 473, 474, 222/556, 575, 576, 108

[56] References Cited

UNITED STATES PATENTS

| | | | |
|---|---|---|---|
| 1,743,293 | 1/1930 | Toft | 222/556 X |
| 2,272,798 | 2/1942 | Hacmac | 222/472 X |
| 2,312,380 | 3/1943 | Bernhardt | 222/472 X |
| 2,380,906 | 7/1945 | Gessler | 222/473 X |
| 3,212,686 | 10/1965 | Pierro et al. | 222/472 |

*Primary Examiner*—Allen N. Knowles
*Assistant Examiner*—Norman L. Stack
*Attorney, Agent, or Firm*—Townsend and Townsend

[57] ABSTRACT

A device for use with a liquid container to control the flow of liquid poured from the container so as to eliminate dribbling or flow along the outer surface of the container, i.e., to eliminate the "teapot effect". The device has a spoon-shaped lower surface and is positioned near the upper edge of the container with a portion of such surface normally below the lip so that, when the receptacle is tilted, the liquid will contact the spoon-shaped surface before reaching the lip. Thus, the liquid flows along the surface and outwardly from the container rather than over and downwardly from the lip. The spoon-shaped surface also provides a guide for liquid returning to the container when the latter returns to its upright position after being tilted during pouring. Several embodiments of the device are disclosed.

11 Claims, 9 Drawing Figures

FIG. 1
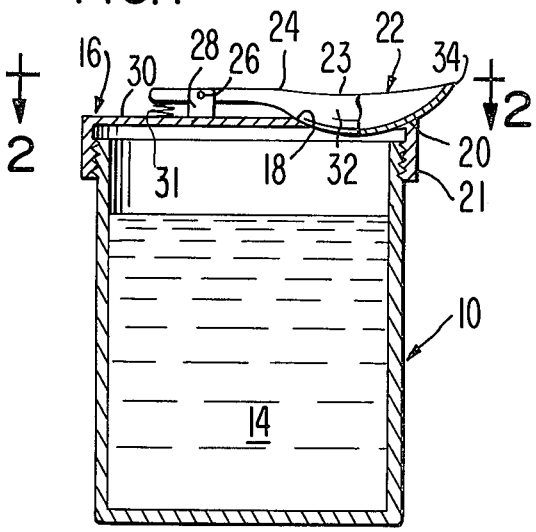
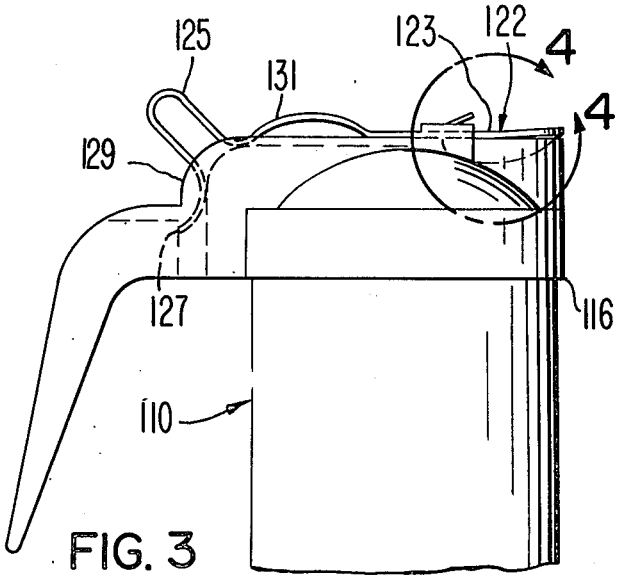
FIG. 3
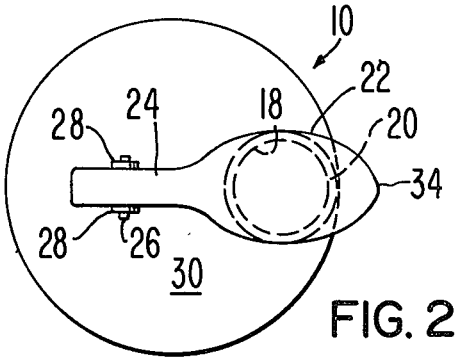
FIG. 2
FIG. 4
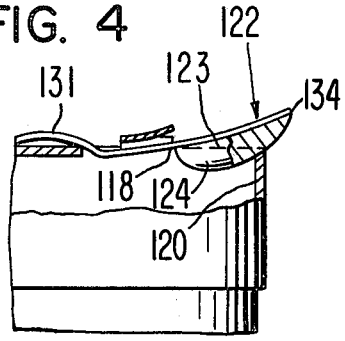
FIG. 5
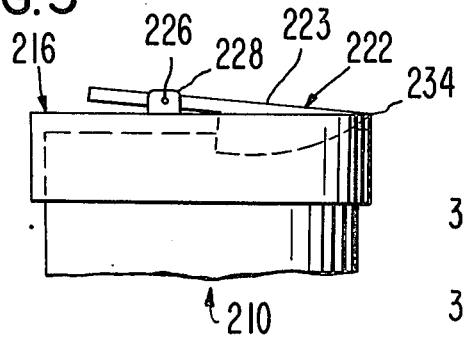
FIG. 7
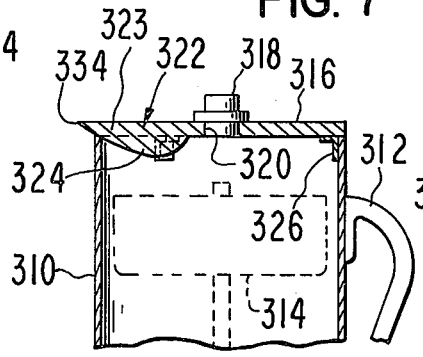
FIG. 7A
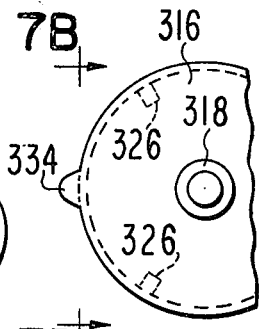
FIG. 6
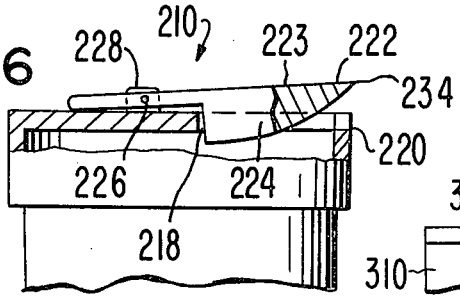
FIG. 7B
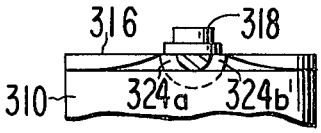
INVENTOR.
RONALD F. TUCKER
BY Townsend and Townsend
ATTORNEYS

LIQUID CONTAINER WITH IMPROVED POURING UNIT

This is a continuation of application Ser. No. 399,677, filed Sept. 21, 1973 which was a continuation of application Ser. No. 207,390, filed Dec. 13, 1971 both now abandoned.

This invention relates to improvement in the control of the flow of liquids from containers and, more particularly, to a device for eliminating the "teapot effect" associated with liquid containers.

In attempting to pour or decant liquids slowly from containers, pots or pitchers or the like, as when the container is nearly full, the liquid tends to "dribble" over the edge and follow the surface to the bottom and fall away in an uncontrolled fashion. This phenomenon is quite frequently referred to as the "teapot effect". This effect can be not only a source of annoyance, but when pouring extremely hot, cold or corrosive liquids, it can be hazardous. Attempts to modify pouring spouts or lips on pouring or serving vessels have not been successful in combating this effect. In addition, after pouring, when the vessel is returned to the upright position, drops remaining on the edge of the spout tend to drip or gravitate down the sides of the vessel.

In order to facilitate pouring from pitchers, coffeepots, beakers, and the like, it is common practice to form an indentation or lip in the periphery of such vessels. This requires a special manufacturing step and, in the case of glass or ceramic vessels, severly weakens an otherwise strong structure.

The present invention provides a solution to the drip problem mentioned above by providing an improved pouring control device for use with a liquid container wherein the control device has a spoon-shaped lower surface which guides liquid poured from a tilted container outwardly therefrom a stream to prevent the dribbling of the liquid along the outer surface of the container as often occurs, such as when the container is full or nearly so. The spoon-shaped lower surface of the device is arranged so that during the initial act of tilting the container to pour liquid therefrom, the liquid will first contact the spoon-shaped surface before contacting the adjacent upper edge of the container. When this occurs, the liquid remains in contact with such surface and flows away therefrom and thereby from the container in a stream so that the liquid has no chance to dribble along the side of the container. Also, the liquid remains in contact with the spoonshaped surface even as the container is returned to an upright position. In so doing, the liquid bypasses the container's upper edge and returns by way of the spoon-shaped surface to the interior of the container, thereby eliminating post-pouring drippage.

The foregoing advantages are achieved even though the container has no pouring lip or spout formed in its upper edge. This feature allows for reduced manufacturing costs since the teachings of this invention can be carried out even with simple, inexpensive liquid containers, such as open top jars, beakers and the like. This lip-free construction also allows glass or ceramic containers to be much stronger and more durable than conventional containers with integral, pouring lips.

The primary object of the present invention is to provide an improved liquid pouring control device for a liquid container wherein the device has a spoon-shaped lower surface for engaging the liquid in the container before the liquid contacts the adjacent upper edge of the container during a pouring step to thereby assure that the liquid will remain in contact with such surface during and after a pouring operation so as to eliminate the "teapot effect" and post-pouring drippage.

A further object of this invention is to provide a control device of the type described wherein the device is suitable for use with containers having no pouring lips or spouts to thereby reduce container costs and allow containers made from certain materials, such as glass or ceramic, to be stronger than conventional containers.

Other objects of this invention will become apparent as the following specification progresses, reference being had to the accompanying drawing for an illustration of several embodiments of the invention.

In the drawing:

FIG. 1 is a cross-sectional view of one form of the control device of this invention, showing its use on a conventional refrigerator store-and-serve vessel;

FIG. 2 is a top plan view of the device of FIG. 1;

FIG. 3 is a fragmentary, side elevational view of another form of the device mounted on a conventional serving pitcher, showing the device closing the liquid exit opening of the pitcher;

FIG. 4 is an enlarged, fragmentary, side elevational view of the container of FIG. 3 looking in the vicinity of circular line 4—4 of FIG. 3, parts being broken away and in section to illustrate the control device thereof in an operable position;

FIG. 5 is a side elevational view of a third form of the invention with the control device being used as a stopper for closing the liquid exit opening of the container.

FIG. 6 is a view similar to FIG. 5 but showing the control device thereof in an operative position;

FIG. 7 is a view similar to FIG. 1 but showing a fourth form of the control device;

FIG. *7a* is a fragmentary, top plan view of the device of FIG. 7; and

FIG. *7b* is a cross-sectional view taken along line *7b—7b* of FIG. *7a*.

The first form of the liquid pouring control device of the invention is illustrated in FIGS. 1 and 2 in use with the screw-top lid of a conventional refrigerator store-and-serve vessel, wherein the vessel comprises a liquid container 10 having an open top and adapted to contain a volume of liquid 14 therein. The lid 16 is screw-mounted on the container to cover the open top thereof. Lid 16 has an opening 18 therethrough near the outer periphery thereof and adjacent to a curved lip 20 defined by an upper portion of a skirt 21 forming a part of the lid. A stopper (not shown) is the conventional means for closing opening 18; however, such a stopper is not needed as will hereinafter be set forth.

The pouring control device, denoted by the numeral 22, includes a spoon-shaped member 23 and an extension 24 rigid at one end to member 23 and pivotally mounted near its opposite end on a pair of spaced ears secured to and extending upwardly from the upper surface 30 of lid 16. Member 23 is biased into the position of FIG. 1 in covering relationship to opening 18 by a coil spring 31 between the opposite end of extension 24 and lid 16.

Member 23 has a lower spoon-shaped surface 32 which normally extends into opening 18 as shown in FIG. 1 below lip 20. The shape of the surface 32 is such that opening 18 will effectively be closed by member 23. Also, the portion of lid 16 defining the outer, continuous boundary of opening 18 is shaped, i.e., beveled, so as to be complemental to the adjacent portions of surface 32. Member 23 may have a flat, upper surface or such upper surface could be concave in the same manner as a conventional spoon.

When member 23 is in its closed position (FIG. 1), a portion of surface 32 is below the upper extremity of lip 20 as shown in FIG. 1. Also, member 23 remains in covering relationship to opening 18 for substantially all tilted positions which the container may assume until liquid engages surface 32 and forces member 23 outwardly of opening 18 against the bias of spring 31. Thus, the liquid will first contact the portion of surface 32 below lip 20 before passing to the lip.

In use, liquid 14 is directed into the container through the open top thereof, then lid 16 with control device 22 mounted thereon is secured in place. Member 23, in its initial position, covers opening 18 and rests on and projects laterally from lip 20.

When it is desired to pour liquid 14 from the receptacle, the latter is tilted sufficiently until the liquid engages surface 32 as member 23 continues to cover opening 18. When this occurs, the liquid forces member 23 against the bias of spring 31 and out of covering relationship to opening 18. When this occurs, the liquid continues to adhere to and follow spoon-shaped surface 32 rather than contact and flow over lip 20. Also, the liquid continues to contact member 23 until it reaches the outer, tapered tip 34 thereof and converges to and leaves tip 34 in a relatively narrow stream. Substantially none of the liquid flows over and down from lip 20 during pouring. Thus, even though the container is full or nearly so, liquid will exit therefrom in a stream which extends outwardly from member 23 so as to eliminate the "teapot effect" which might otherwise be associated with container 10 and lid 16.

When container 10 is returned to its upright position, after a pouring step, the liquid will flow back into the container along surface 32 and will remain out of contact with lip 20. Thus, the liquid will not drip from the lip along the side of the container. The liquid will drip from the lowermost extremity of surface 32 but such location is spaced inwardly of lip 20. Member 23 automatically returns to its initial position shown in FIG. 1 when the bias force of spring 31 overcomes the force due to liquid contact with surface 32.

The liquid pouring control device can be used with other types of liquid containers or pitchers. For instance, it can be used with a conventional serving pitcher (FIGS. 3 and 4) which includes a container 110 having an open top and provided with a lid or cover 116 which is generally screw-threaded onto the container. Lid 116 has an opening 118 (FIG. 4) therethrough near the outer periphery of the lid, the opening defining a curved lip 120.

The liquid pouring control device, denoted by the numeral 122 has a spoon-shaped member 123 provided with a spoon-shaped lower surface 124, member 123 being secured to one end of an elongated, shiftable, flat extension 131 extending along the upper extremity of lid 116 as shown in FIG. 3. The extension is of the type which generally is supplied with such a serving pitcher, whereby the extension serves to close opening 118 and to be moved by the thumb to a position clearing the opening during a pouring step. For purposes of illustration only, extension 131 has an integral loop 125 whose free end 127 is anchored in a recess 129 on the outer periphery of lid 116 remote from opening 118. By forcing loop 125 toward lip 120 with the thumb, extension 131 causes member 123, mounted on the lower flat face of extension 131, to advance laterally of lip 120 so that lower surface 124 of member 123 moves upwardly of and over the lip 120 and into the operative position shown in FIG. 4 in which it projects laterally and outwardly from lip 120 at a slight angle with respect thereto. Side openings, on the opposite sides of the portion of surface 124 in engagement with lip 120, allow liquid to flow out of the container and along surface 124 when the container is tilted.

As also shown in FIG. 4, lower surface 124 normally extends below lip 120 when member 123 is in its operative position. Thus, liquid will engage surface 124 before the liquid contacts lip 120 as receptacle 110 is tilted to pour liquid therefrom. Because of this feature, the liquid will follow surface 124 and will remain in contact therewith until it reaches the outer, tapered tip 134 thereof. This tip effectively guides the liquid and directs the same into a relatively narrow stream for convenience of pouring. In this way, the liquid effectively bypasses lip 120 and adheres at all times to surface 124 and leaves the same at a location spaced laterally of and outwardly from lip 120 so as to eliminate the "teapot effect".

When the receptacle is returned to an upright position, the liquid will follow surface 124 back into the receptacle rather than contact lip 120. Thus, there will be no post-pouring drip along the outside of the container. When thumb pressure is released from loop 125, member 123 returns to its initial position (FIG. 3), thereby closing opening 118 while assuring that substantially all of the liquid in contact with surface 124 will return along the latter into the receptacle rather than gravitating from such surface onto and past lip 120.

Member 123 is of a solid construction and can be made from any suitable material, such as plastic or the like. Member 123 is secured in any suitable manner to extension 131, the latter also being adapted to close opening 118 in the position of FIG. 3.

In FIGS. 5 and 6, a third form of the control device is shown. In this case, the device, denoted by the numeral 222, has a spoon-shaped member 223 which is adapted to serve as a snugfitting stopper in an opening 218 in the lid 216 of a liquid container 210. Opening 218 is near a lip 220 and is adapted to be closed by spoon-shaped member 223 whose spoon-shaped lower surface 224 is normally disposed below lip 220 as shown in FIG. 5.

Member 223 has a tapered, outer tip 234 which is adjacent to lip 220 when member 223 is in the closed position (FIG. 5). An extension 231 secured to member 223 extends along the upper surface of lid 216 and is pivotally mounted by a pin 226 on a pair of spaced ears 228 rigid to and projecting upwardly from lid 216. Member 223 is of a solid construction and formed from any suitable material, such as plastic or the like. Member 223 is moved to the open position (FIG. 6) when liquid engages surface 224 as the container is initially tilted for pouring. Also, member 223 is held by its own weight in contact with the liquid during a pouring step.

In its initial position (FIG. 5), member 223 snugly covers openings 218 as shown in FIG. 5. When container 210 is tilted, liquid flows toward opening 218 and first contacts lower surface 224 before the liquid reaches lip 220 since surface 224 will be below lip 220 when member 223 is in the closed position. The liquid then forces members 223 outwardly of opening 218 against its own weight and the liquid remains in contact with surface 224 as the liquid exits through opening 218. The tapered end 234 of member 223 guides the liquid into a relatively narrow stream to facilitate pouring therefrom. The liquid, therefore, does not pass over and downwardly from lip 220; instead, the liquid remains in contact with surface 224 at a location spaced laterally of and outwardly from lip 220 so as to eliminate the "teapot effect".

When the container is returned to its upright position, the liquid returns by gravity back to the receptacle along surface 224; the liquid continues to adhere to surface 224 and does not drip from lip 220. Also, member 223 returns by gravity to its initial position shown in FIG. 5.

The teachings of the present invention are suitable with an open top liquid container of the type having no laterally projecting pouring lip or spout. This is illustrated in FIGS. 7, *7a* and *7b* wherein a container 310 has an upper, generally continuous edge 311 free of any such lip or spout. This construction reduces manufacturing costs and, when glass or ceramic materials are used, results in a stronger construction. For purposes of illustration only container 310 comprises a coffee maker having a handle 312 at one side thereof and the usual drip-type coffee maker 314 therewithin. A circular lid 316 having a liquid pouring control device 322 thereon is adapted to cover the open top of container 310. Lid 316 has a glass insert 318 covering the usual opening 320 found in percolator coffeepots. However, insert 318 is not essential to the operation of the coffee maker.

Device 322 includes a spoon-shaped member 323 having a spoon-shaped lower surface 324 which is partially within and partially without the confines of the open top of the container when the lid is in the operative position of FIG. 7. A number of spring clips 326 carried by lid 316 are adapted to releasably secure the lid to the container. Clips 326 are adapted to engage the inner surface of the container near the open top thereof. As shown in FIG. *7b*, the regions near opposed surface portions 324*a* and 324*b* are open because of the spoon-shaped configuration of surface 324. Thus, these regions provide openings by which the liquid can flow out of container 310 without removing lid 316. Also, surface 324 has a lowermost extremity below the adjacent upper edge portion of the container; thus, when the container is tilted for pouring, the liquid will first contact surface 324 before passing over the adjacent upper edge portion of the container.

During the pouring, the liquid will flow along surface 324 until it separates from the outer tip 334 thereof in a stream. Thus, surface 324 eliminates the "teapot effect" and prevents liquid from dribbling down the side of the container below the outwardly projecting tip 334 of device 322.

Liquids of many different types can be readily poured from containers using the teachings of the present invention. The invention is suitable for use with dangerous or noxious liquids as well as extremely cold liquids, such as liquid nitrogen.

I claim:

1. In a container having means defining an upper edge portion of said container over which liquid can pass as the liquid is poured from the container; a liquid pouring control device having a spoon-shaped lower, outer surface and a normally forwardmost tip, said surface having a normally lowermost portion and tapering smoothly and being unobstructed from said lowermost portion forwardly to said tip; and means coupled to the device for shiftably mounting the same on said container at a location permitting said lowermost portion to be initially disposed below said upper edge portion and to be moved upwardly relative to said upper edge portion as said lowermost portion is engaged by a liquid when the container is initially tilted to start the pouring of the liquid therefrom, said device being disposed to permit said surface to define the upper boundary of the opening through which the liquid passes as said lowermost portion is engaged by the liquid, whereby liquid will contact said lower surface and will flow forwardly along the same past and beyond said upper edge portion to and beyond said tip.

2. In a container as set forth in claim 1, wherein said device includes an elongated extension secured to and extending across the top of the container, said mounting means including pivot structure for pivotally mounting the extension on the lid.

3. In a container as set forth in claim 1, wherein said device includes a spoon-shaped member having said lower surface and an elongated extension adapted to be mounted on said lid for movement laterally of and across at least a portion of the lid, said member being secured to one end of the extension and means on the extension near its opposite end for allowing finger pressure to be applied thereto to move it in a predetermined direction.

4. In a container as set forth in claim 1, wherein said lid has an opening therethrough near said upper edge portion, said device having a member substantially complemental to said opening so as to snugly close the same.

5. In a liquid container having an open top; a lid adapted to be mounted on the open top of the container, said lid having an opening therethrough and a pouring lip adjacent to said opening; a liquid pouring control device having an outer, spoon-shaped lower surface and a outer, normally forwardmost tip, said lower surface having a normally lowermost portion and tapering smoothly and being unobstructed from said lowermost portion forwardly to said tip, said device being mounted on said lid for movement relative thereto from a first location substantially covering the opening to a second location at least partially clearing said opening, said device being disposed with said lowermost portion of the lower surface below the lip and below an interior surface of the lid when said device is in said first location, said surface defining the upper boundary of the opening through which the liquid passes as the device is in said second location, whereby liquid in the container will engage and follow said lower surface to and beyond said tip when the container is tilted to pour the liquid therefrom.

6. In a liquid container as set forth in claim 5, wherein said device is pivotally mounted on said lid, and means coupled with the device for biasing the same into said first location.

7. In a liquid container as set forth in claim 5, wherein said device has an elongated, flat extension thereon, and means coupled with the extension for mounting the same on the lid for movement relative thereto and laterally of the opening, whereby said lower surface can be moved over and beyond said lip.

8. In a liquid container as set forth in claim 5, wherein said device includes a member having said lower surface thereon and provided with a concave upper surface, the opening being substantially complemental to at least a portion of said lower surface.

9. Liquid dispensing means comprising: a container member having an open top; a lid member for the open top of the container member, the lid member having a portion at least partially overlying said open top, one of the members having means defining a pouring edge over which liquid passes as the liquid is poured from the container member when said lid member portion at least partially overlies the open top; and a liquid pouring control device having a spoon-shaped lower surface and an outer tip, said lower surface having a normally lowermost portion and tapering smoothly and being unobstructed from said lowermost portion to said tip, said device being positioned so that said lowermost portion of the lower surface is normally disposed below said pouring edge and below an interior surface of the lid while at least a part of said lower surface is spaced from said pouring edge to permit liquid to engage said lower surface and to flow toward and past said lip to and beyond said tip while the liquid engages said lower surface when the container member has been tilted to allow the liquid to be poured therefrom without dripping from the lid or the top.

10. A container as set forth in claim 9, wherein said opening is in said lid, said pouring edge defining an upper extremity of said lid.

11. Apparatus for dispensing liquid in a controlled discharge of liquid without dripping comprising: a container having an open top, a lid secured to the container and closing the top, the lid including a circumferential edge and an opening communicating the interior of the container with the exterior, the opening contacting the edge and having a transverse dimension substantially less than the transverse dimension of the lid, a liquid pouring control device having a spoon-shaped lower surface, a first portion of the spoon-shaped surface projecting through the opening into the interior of the container to below an interior surface of the lid, the spoon-shaped surface having a configuration to contact a periphery of the opening to act as a closure for the opening, a remaining second portion of the spoon-shaped surface further defining a generally tapered surface terminating in an outer tip, the first portion and the second portion being contiguous, said convex surface being unobstructed from said first portion to said outer tip, and means mounting the device to the lid so that the first portion normally projects into the container interior and the tip is disposed above and beyond the lid peripheral edge, whereby liquid can be poured from the container in a constant, concentrated stream by inclining the container so that liquid within the container contacts the first portion and separates such portion from the opening, and the liquid contacting the first portion flows along the tapered portion to the tip and leaves the tip in such a concentrated stream.

* * * * *